US007044780B2

(12) United States Patent
Ma

(10) Patent No.: US 7,044,780 B2
(45) Date of Patent: May 16, 2006

(54) ELECTRONIC DEVICE AND LOCK DEVICE FOR LOCKING MODULE OF ELECTRONIC DEVICE

(75) Inventor: Hai-Tao Ma, Wu Chung (CN)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/970,038

(22) Filed: Oct. 21, 2004

(65) Prior Publication Data

US 2005/0090133 A1 Apr. 28, 2005

(30) Foreign Application Priority Data

Oct. 22, 2003 (TW) ..... 92129261 A

(51) Int. Cl.
*H01R 13/73* (2006.01)

(52) U.S. Cl. ..... 439/553; 439/911

(58) Field of Classification Search ..... 439/553, 439/575, 911, 352, 91, 131
See application file for complete search history.

(56) References Cited

U.S. PATENT DOCUMENTS

| | | | | |
|---|---|---|---|---|
| 5,192,225 | A * | 3/1993 | Suzuki | 439/489 |
| 5,376,014 | A * | 12/1994 | Sumida | 439/310 |
| 5,603,630 | A * | 2/1997 | Villain | 439/347 |
| 6,083,030 | A * | 7/2000 | Wright | 439/352 |
| 6,902,421 | B1 * | 6/2005 | Huang | 439/372 |
| 2002/0177362 | A1 * | 11/2002 | Chang | 439/638 |

* cited by examiner

*Primary Examiner*—Hien Vu
(74) *Attorney, Agent, or Firm*—Snell & Wilmer L.L.P.

(57) ABSTRACT

An electronic device and a lock device for locking the module of the electronic device are disclosed. The electronic device includes a module, a connection interface, a plug, and a chassis. The module is movably disposed on the chassis. The connection interface is disposed on the chassis and is electrically coupled to the module. The lock device includes a lock part, an elastic unit, and a contact part. The lock device is movably disposed on the chassis. When the plug is not in connection with the connection interface, the lock part locks the module. The elastic unit provides a predetermined force to affix the module. When the plug connects the connection interface, the plug pushes the contact part of the lock device for moving a predetermined distance to release the module.

13 Claims, 7 Drawing Sheets

ELECTRONIC DEVICE AND LOCK DEVICE FOR LOCKING MODULE OF ELECTRONIC DEVICE

CROSS-REFERENCE TO RELATED APPLICATIONS

This application claims priority to Taiwan Patent Application Serial No. 092129261 entitled "Electronic Device and Lock Device for Locking Module of Electronic Device," filed on Oct. 22, 2003.

1. Field of Invention

The present invention relates to a mechanical lock device within an electronic device, and more particularly relates to a lock device for locking a module of an electronic device.

2. Background of the Invention

In recent years, a variety of computer peripherals have become more and more popular due to the great improvement and advancement of the computer related technologies in industries. Many of these computer peripherals contain movable modules therein, for example, an image capturing module within a scanner, a print module within a printer, a copy module within a copier, and other electronic devices with similar configurations. These electronic devices generally contain lock devices to affix the modules therein in order to prevent damages from shaking and vibrations during transportation.

For example, a scanner (prior art) usually has a lock to affix the image capturing module. End users have to release the lock before they can actually use the scanner. However, such designs are problematic under operation. Somehow, users do not always release the lock before turning on the scanner. In these circumstances, not only will the scanners not function properly, but the scanners may suffer permanent damage.

SUMMARY OF THE INVENTION

The present invention discloses a lock device within an electronic device. The electronic device includes a module, a connection interface, a plug and a chassis. The module is movably disposed on the chassis. The connection interface is disposed on the chassis and is electrically coupled to the module. The lock device includes a lock part, an elastic unit, and a contact part. The lock device is movably disposed on the chassis. When the plug is not in connection with the connection interface, the lock part locks the module. The elastic unit provides a predetermined force to affix the module. When the plug is inserted and connected to the connection interface, the plug pushes the contact part of the lock device for moving a predetermined distance to release the module.

When the plug is pulled out, the predetermined force provided by the elastic unit pushes the lock device back and the lock device locks the module again.

In the present invention, the plug is optionally connected and electrically coupled to the connection interface. The plug further includes a transmission cable for communication with the external electronic device. The connection interface is electrically coupled to the plug, when the plug connects to the connection interface. The module could communicate with the external electronic device through the connection interface and the transmission cable.

DETAILED DESCRIPTION

Figure 1:
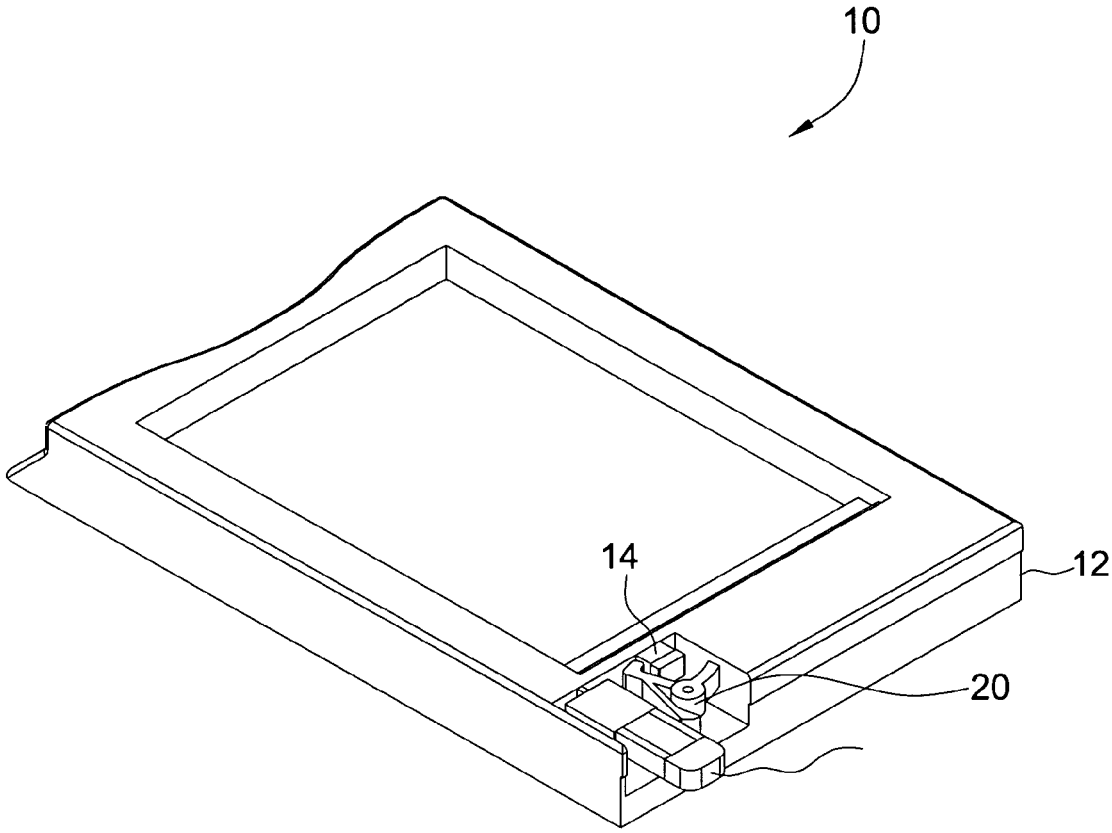
FIG. 1 shows the electronic device and lock device in the first embodiment of the present invention.

FIG. 1 illustrates a lock device 20 within an electronic device 10 in the first embodiment of the present invention. In this embodiment, the electronic device 10 is a scanner, but the usage of the present invention shall not be limited only to such application. The lock device 20 is movably disposed on the chassis 12 of the electronic device 10. The lock device 20 locks the movable module 14 on the electronic device 10 to prevent the module 14 from being damaged when the electronic device 10 is not in use or in situations such as shocks and impacts during transportation. In this embodiment of the presentation, the module 14 is an optical image capturing module.

Figure 2A:
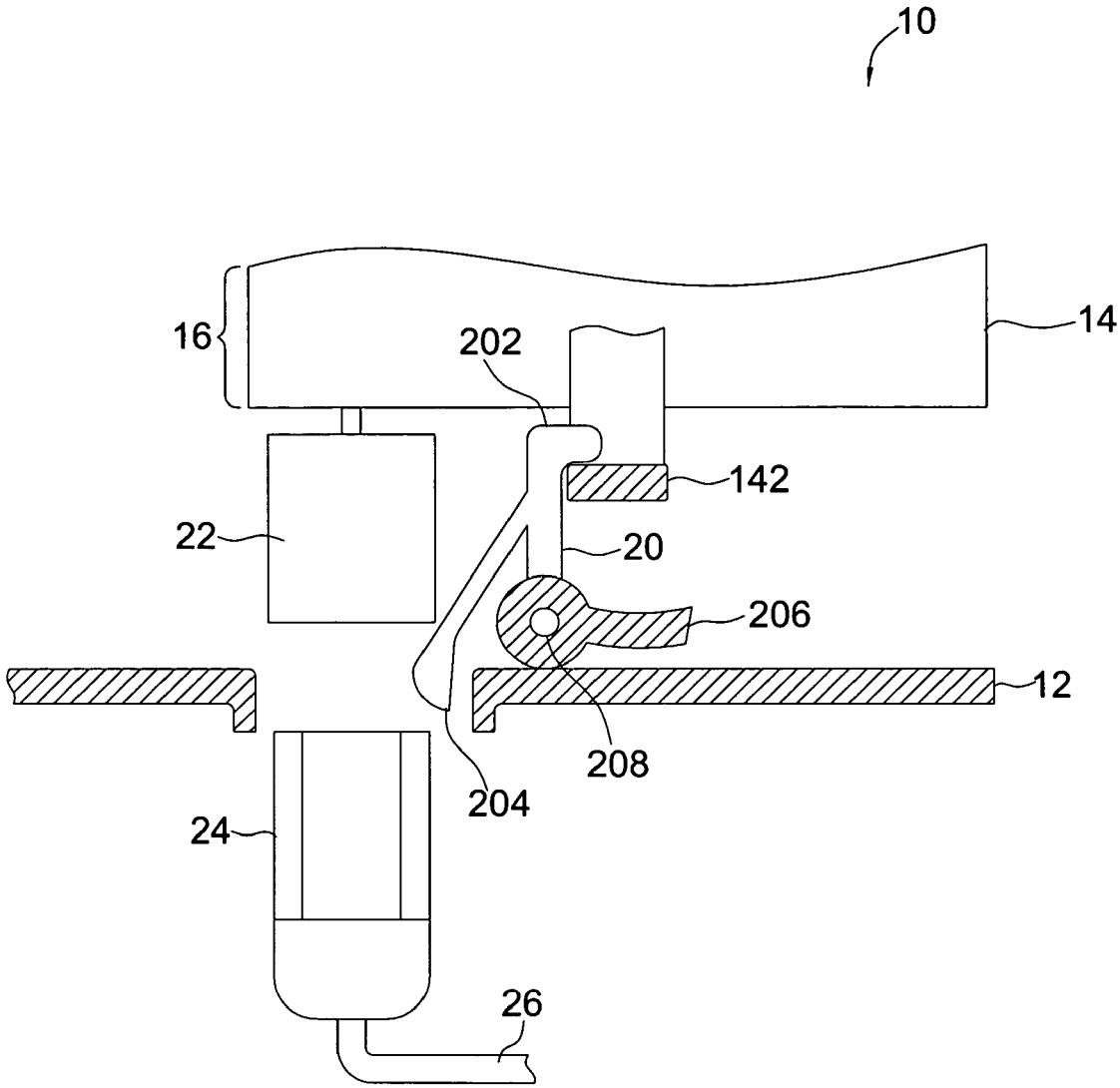
FIG. 2*a* is a schematic diagram of a lock device within the electronic device shown in FIG. 1 for locking a module.
Figure 2B:
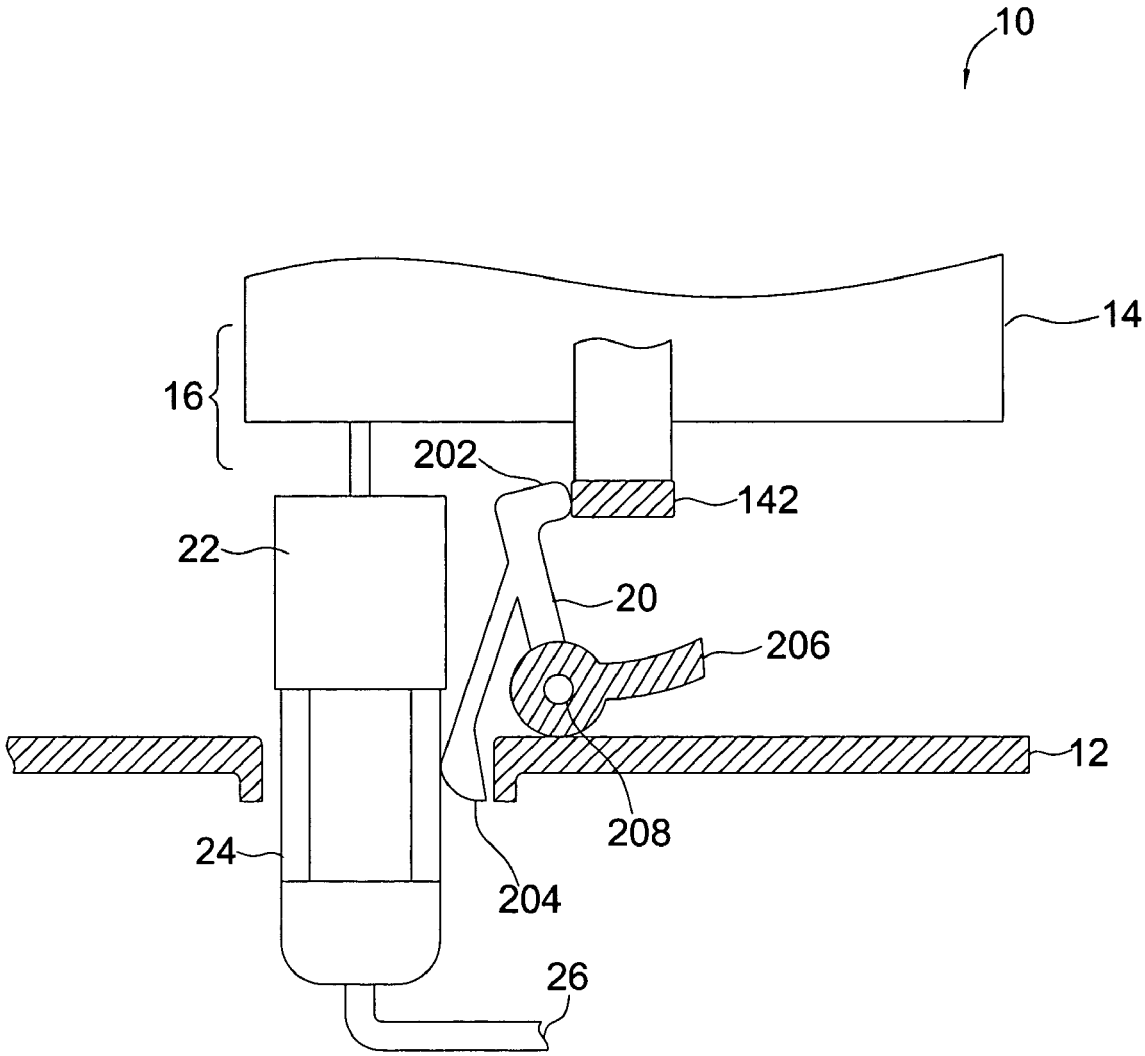
FIG. 2*b* is a schematic diagram of the lock device shown in FIG. 2*a* releasing the module.

FIG. 2*a* and FIG. 2*b* illustrate partially enlarged images of electronic device 10 and lock device 20 from FIG. 1. The electronic device 10 consists of a chassis 12, a module 14 and a connection interface 22. The module 14 is movably disposed on the chassis 12 at a home position 16. The connection interface 22 is disposed on the chassis 12 near the home position 16 and is electrically coupled to the module 14. The connection interface 22 could optionally connect to a plug 24 of an external electronic device (not shown). In this embodiment of the invention, the possible external electronic device includes a desktop personal computer, a notebook, or other products with similar functions. The plug 24 further includes a transmission cable 26 for communicating with the external electronic device. Optionally, the connection interface 62 is electrically coupled to the plug 24. When the plug 24 connects to the connection interface 22, the module 14 communicates with the external electronic device through the connection interface 22 and the transmission cable 26. In this embodiment of the invention, the connection device 22 is a Universal Serial Bus (USB) socket, the plug 24 is a Universal Serial Bus connector and the transmission cable 26 is a USB cable. The external electronic device communicates with the module 14 of the electronic device 10 through the connection of the USB socket, USB connector and USB cable. The communication hereof refers to but is not limited to transmission and receipt of electronic signals, or transfer of electrical power. It should be noted that the USB interface mentioned above is merely an exemplary embodiment and is not intended to limit the application of the present invention. Indeed, any kind of interface with similar functions could be used with the present invention.

FIG. 2*a* illustrates a diagram of lock device 20 locking the module 14 at the home position 16. The lock device 20 consists of a lock part 202, an elastic unit 206 and a contact part 204. The lock device 20 is movably disposed on the chassis 12. In this embodiment, the lock device 20 also includes an axle 208, and thus the lock device 20 is rotatably disposed on the chassis 12 by means of the axle 208. When the plug 24 is disconnected from the connection interface 22, the lock part 202 locks the module 14, and the contact part 204 protrudes from the connection interface 22. In this embodiment, the lock part 202 includes a protrusion and the module 14 includes a block 142. The lock part 202 engages with the block 142 to affix the module 14 at the home position 16. One end of the elastic unit 206 connects to the chassis 12 and provides a predetermined elastic force to affix the module 14 at the home position 16. In this embodiment, the mentioned elastic unit 206 is a spring.

FIG. 2*b* illustrates a diagram of the lock device 20 releasing the module 14. When the plug 24 connects to the connection interface 22, the plug 24 pushes the contact part 204 to overcome the predetermined elastic force of the elastic unit 206. At the same time, the lock device 20 rotates for a small angle and causes the lock part 202 to release the module 14. Thus, the electronic device 10 is ready to be used. When the plug 24 is pulled out again, the predetermined elastic force of the elastic unit 206 pushes the lock device 20 back to its original position and hence locks the module 14 again.

By means of applying the lock device 20 of the present invention, users would not be troubled in above-mentioned condition of running the device without releasing the locks. Take the embodiment of the scanner as an example, user must connect scanner to the external electronic device, e.g. a computer, before using use the scanner. In other words, the USB connector must connect to the USB socket in order to turn on the scanner in the embodiment. Therefore, the USB connector triggers the lock device to release the module. Moreover, the lock device 20 of the present invention is a mechanical design and could function without electrically controlled mechanism, which lowers the manufacturing cost and complexity.

Figure 3A:
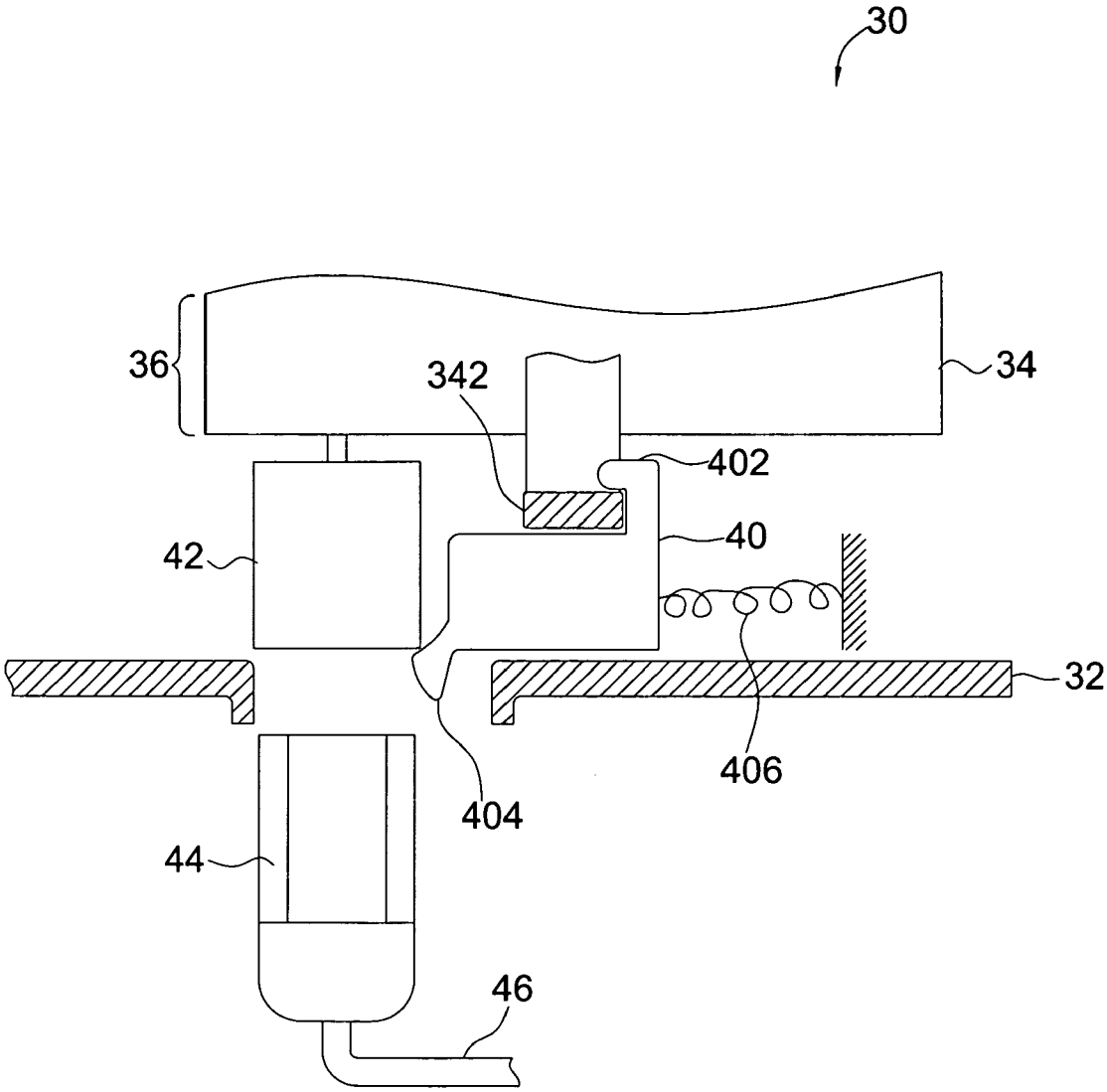
FIG. 3*a* is a schematic diagram of a lock device for locking a module in the second embodiment of the present invention.
Figure 3B:
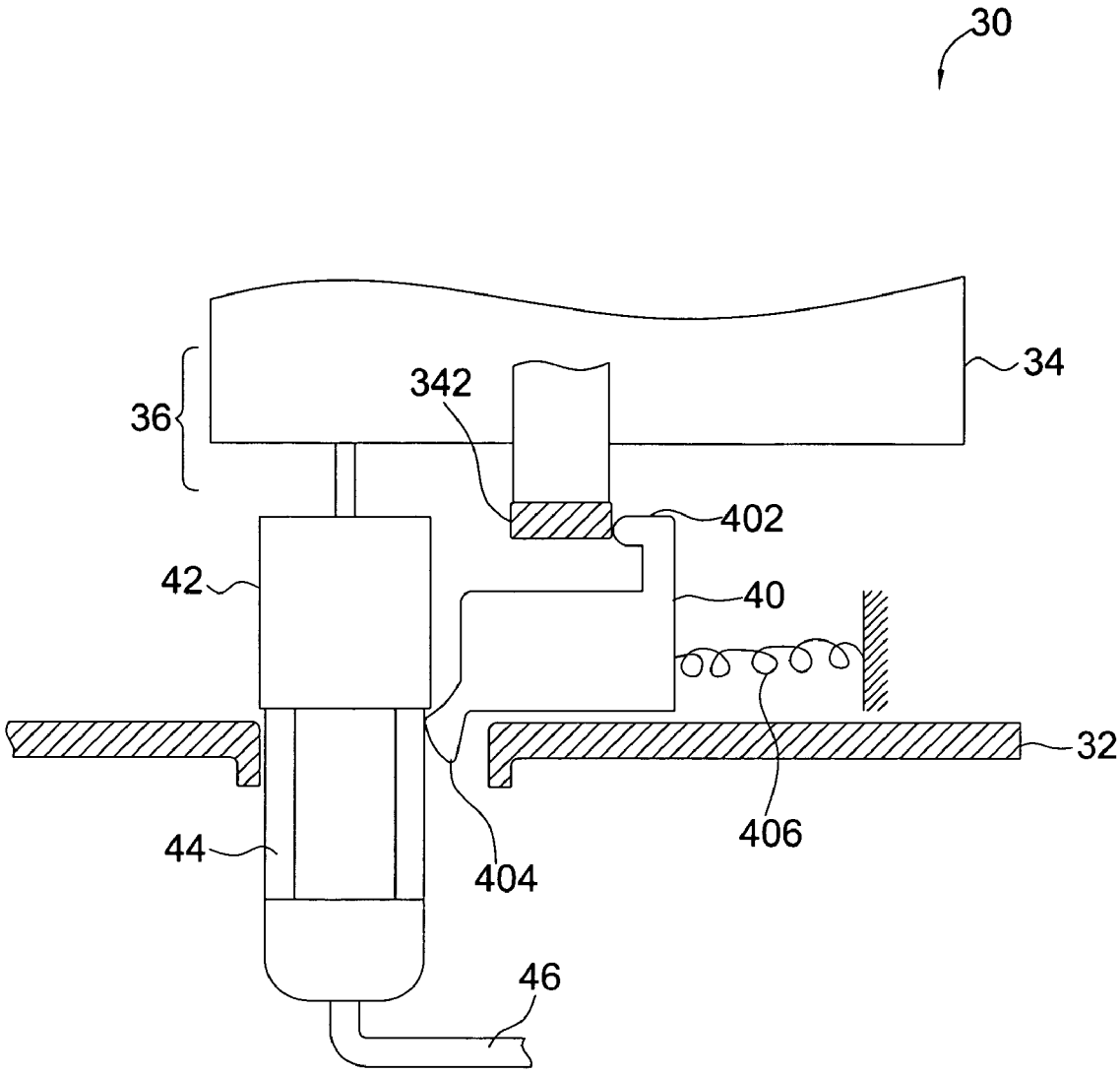
FIG. 3*b* is a schematic diagram of the lock device shown in FIG. 3*a* releasing the module.

FIG. 3*a* and FIG. 3*b* illustrate partially enlarged images of a lock device 40 within an electronic device 30 in the second embodiment of the present invention. The electronic device 30 consists of a chassis 32, a module 34 and a connection interface 42. The module 34 is movably disposed on the chassis 32 at a home position 36. The connection interface 42 is disposed on the chassis 32 near to the home position 36 and is electrically coupled to the module 34. The connection interface 42 optionally connects to a plug 44 of an external electronic device (not shown). In this embodiment, the external electronic device is a power supply or the like, which provides electrical power to the electronic device 30. The plug 44 further includes a transmission cable 46. Optionally, the connection interface 42 is electrically coupled to the plug 44. When the plug 44 connects to the connection interface 42, the module 34 connects to the external electronic device through the connection interface 42 and the transmission cable 46. In this embodiment, the connection interface 42 is a power socket, the plug 44 is a power connector, and the transmission cable 46 is a power cable.

FIG. 3*a* illustrates a diagram of the lock device 40 locking the module 34 at the home position 36. The lock device 40 includes a lock part 402, an elastic unit 406 and a contact part 404. The lock device 40 is movably disposed on the chassis 32. When the plug 44 is at state of disconnection to the connection interface 42, the lock part 402 locks the module 34, and the contact part 404 protrudes from the connection interface 42. In this embodiment, the lock part 402 includes a protrusion and the module 34 includes a block 342. The lock part 402 engages with the block 342 to affix the module 34 at the home position 36. One end of the elastic unit 406 connects to the chassis 32 and provides a predetermined force to affix the module 34 at the home position 36. In this embodiment, the elastic unit 406 is a spring.

FIG. 3*b* illustrates a diagram of the lock device 40 releasing the module 34. When the plug 44 is inserted to the connection interface 42, the plug 44 pushes the contact part 404 to overcome the predetermined elastic force of the elastic unit 406. The lock device 40 moves over a distance and hence the lock part 402 releases the module 34. Thus, the electronic device 30 is now ready to operate. When the plug 44 is pulled out again, the predetermined elastic force of the elastic unit 406 pushes the lock device 40 back and locks the module 34 once again.

By means of the lock device 40 of the present invention, users would not be troubled in above-mentioned situation of running the device without releasing the locks. Users must connect electronic device to the power supply before using the electronic device. In other words, the power connector must connect to the power socket in order to turn on the electronic device mentioned in the embodiment. Therefore, the power connector triggers the lock device 40 to release the module 34.

Figure 4A:
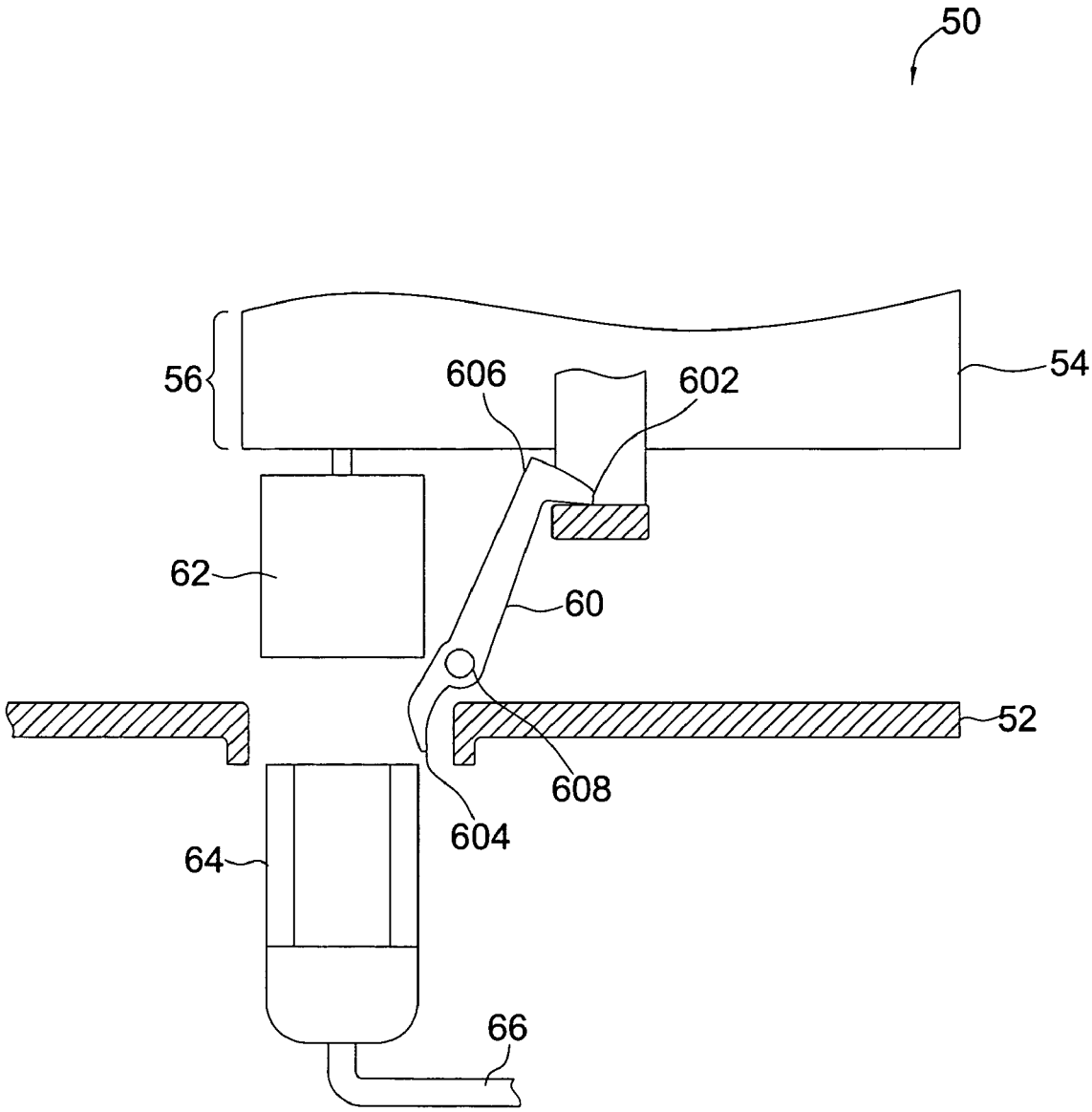
FIG. 4*a* is a schematic diagram of a lock device for locking a module in the third embodiment of the present invention.
Figure 4B:
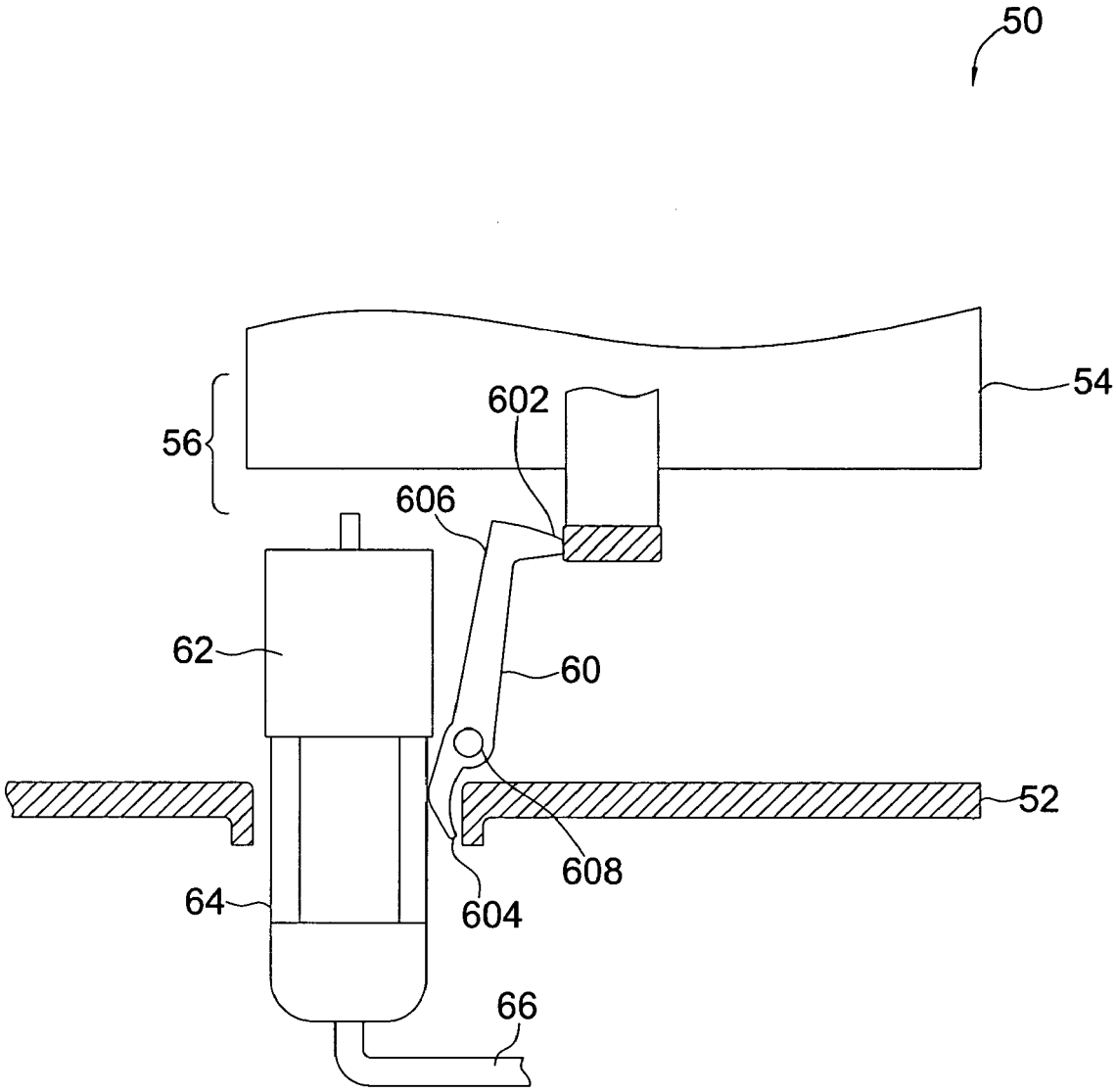
FIG. 4*b* is a schematic diagram of the lock device shown in FIG. 4*a* releasing the module.

FIG. 4*a* and FIG. 4*b* illustrate a lock device 60 within an electronic device 50 in a third embodiment of the present invention. The electronic device 50 includes a chassis 52, a module 54 and a connection interface 62. The module 54 is movably disposed on the chassis 52 at a home position 56. The connection interface 62 is disposed on the chassis 52 near the home position 56 and is electrically coupled to the module 54. The connection interface 62 optionally connects to a plug 64 of an external electronic device (not shown). The plug 64 includes a transmission cable 66 for communicating with the external electronic device. Optionally, the connection interface 62 is electrically coupled to the plug 64. In this embodiment, the connection interface 62 is a Small Computer Standard Interface (SCSI) socket, the plug 64 is a SCSI connector and the transmission cable is a SCSI cable. It should be noted that the SCSI interface mentioned above is merely an exemplary embodiment and is not intended to limit the application of the present invention. Indeed, any kind of interface with similar functions could be adopted for use with the present invention, such as IEEE 1394, PS/2, parallel port, serial port, LAN port, and so on.

FIG. 4*a* illustrates a diagram of the lock device 60 locking the module 54 at the home position 56. The lock device 60 consists of a lock part 602, a magnetic unit 606 and a contact part 604. The lock device 60 is movably disposed on the chassis 52. In this embodiment, the lock device 60 also includes an axle 608, and the lock device 60 is rotatably disposed on the chassis 52 by means of the axle 608. When the plug 64 is not connected to the connection interface 62, the lock part 602 locks the module 54, and the contact part 604 protrudes from the connection interface 62. In this embodiment, the magnetic unit 606 provides a predetermined magnetic force to affix the module 54 at the home position 56.

FIG. 4*b* illustrates a diagram of the lock device 60 releasing the module 54. When the plug 64 is inserted to the connection interface 62, the plug 64 pushes the contact part 604 to overcome the predetermined force of the magnetic unit 606. The lock device 60 rotates for a small angle and hence the lock part 602 releases the module 54. Thus, the electronic device 50 is ready for usage. When the plug 64 is pulled out again, the predetermined force of the magnetic unit 606 pushes the lock device 60 back to its original position and locks the module 54 again.

The spirit and scope of the present invention can be clearly understood by the above detail descriptions of the preferred embodiments. The embodiments are not intended to limit the scope of the invention. Contrarily, various modifications of the illustrative embodiments, as well as other embodiments of the invention, will be apparent to persons skilled in the art upon reference to this description. It is therefore contemplated that the appended claims will cover any such modifications or embodiments as falling within the true scope of the invention.

What is claimed is:

1. A lock device within an electronic device, the electronic device including a chassis, a module movably disposed on the chassis at a home position, the module having a block extended outwardly toward the chassis and a connection socket to be disposed on the chassis near to the home position, the connection socket selectively connecting to a plug of an external electronic device, the lock device comprising:

a hook part movably disposed on the one end of the lock device for engaging with the block;

an elastic unit, one end of the elastic unit connecting to the chassis and providing a predetermined force to affix the module at the home position; and a contact part protruding from the other end of the lock device and interfering with a connection between the connection socket and the plug when the module is in the home position, wherein the plug pushes the contact part to overcome the predetermined force, when the plug connects to the connection socket, making the lock part release the module.

2. The lock device of claim 1, wherein the plug further comprises a transmission cable for communication with the external electronic device, and wherein the connection socket is electrically coupled to the plug when the plug connects to the connection socket, and the module communicates with the external electronic device through the connection socket and the transmission cable.

3. The lock device of claim 1, further comprising an axle, and the lock device is rotatably disposed on the chassis by means of the axle.

4. The lock device of claim 1, wherein the elastic unit is a spring.

5. The lock device of claim 1, wherein the lock device comprises a magnetic unit providing a force to affix the lock device.

6. The lock device of claim 1, wherein the connection socket comprises a Universal Serial Bus (USB) socket.

7. An electronic device selectively connecting to a plug of an external electronic device, the electronic device comprising:

a chassis;

a module movably disposed on the chassis at a home position, the module having a block extended outwardly toward the chassis;

a connection socket connected to the module and to be disposed on the chassis near to the home position of the module; and a lock device movably disposed on the chassis, the lock device comprising a hook part, an elastic unit, and a contact part, wherein the hook part is movably engaged with the block on the chassis, one end of the elastic unit connects to the chassis and provides a predetermined force to affix the module at the home position, and the contact part protrudes from the lock device at the one end and opposite to the hook part and interfering with a connection between the connection socket and the plug when the module is in the home position;

and wherein the plug pushes the contact part to overcome the predetermined force, when the plug connects to the connection socket, making the lock part to release the module.

8. The electronic device of claim 7, wherein the plug further comprises a transmission cable for communicating with the external electronic device, and the connection socket is electrically coupled to the plug, when the plug connects to the connection socket, and the module communicates with the external electronic device through the connection socket and the transmission cable.

9. The electronic device of claim 7, further comprising an axle, and the lock device is rotatably disposed on the chassis by means of the axle.

10. The electronic device of claim 7, further comprising an elastic unit providing a force to affix the lock device.

11. The electronic device of claim 7, wherein the lock device further comprises a magnetic unit providing a force to affix the lock device.

12. The electronic device of claim 7, wherein the electronic device is a scanner and the module further comprises an optical image capture unit.

13. The electronic device of claim 7, wherein the connection socket comprises a Universal Serial Bus (USB) socket, and the plug comprises a Universal Serial Bus connector, and wherein the module is electrically coupled to the USB connector through the USB socket when the USB socket connects to the USB connector.

* * * * *